United States Patent [19]

Vance

[11] 4,039,846

[45] Aug. 2, 1977

[54] CONTROL OF A STEAM-HEATING POWER PLANT

[75] Inventor: James R. Vance, Maplewood, N.J.

[73] Assignee: Allied Chemical Corporation, Morris Township, N.J.

[21] Appl. No.: 605,497

[22] Filed: Aug. 18, 1975

[51] Int. Cl.[2] ..... H02P 9/04; F02C 7/02; F01D 15/10

[52] U.S. Cl. ..... 290/4 R; 60/715; 60/667; 290/40 R; 60/707

[58] Field of Search ..... 60/660, 662, 663, 664, 60/665, 667, 706, 707, 711, 715; 290/4, 40, 52

[56] References Cited

U.S. PATENT DOCUMENTS

| | | | |
|---|---|---|---|
| 1,915,983 | 6/1933 | Doran | 60/662 X |
| 3,623,324 | 11/1971 | Eggenberger | 60/711 X |
| 3,812,377 | 5/1974 | Malone | 60/660 X |

FOREIGN PATENT DOCUMENTS

| | | | |
|---|---|---|---|
| 421,947 | 1/1935 | United Kingdom | 60/715 |
| 352,074 | 7/1931 | United Kingdom | 60/715 |

*Primary Examiner*—Allen M. Ostrager
*Attorney, Agent, or Firm*—Gerhard H. Fuchs; Jack B. Murray, Jr.

[57] ABSTRACT

Apparatus for the control of steam-heating power plants to optimize the use of energy in producing the required steam and electrical power comprising means for sensing steam and electricity demands, means for comparing these sensed demands with the electricity and steam output of turbine means in the plant, and means for adjusting operating set points of the turbines and steam generator for coordinated control of power plant energy consumption and production.

2 Claims, 1 Drawing Figure

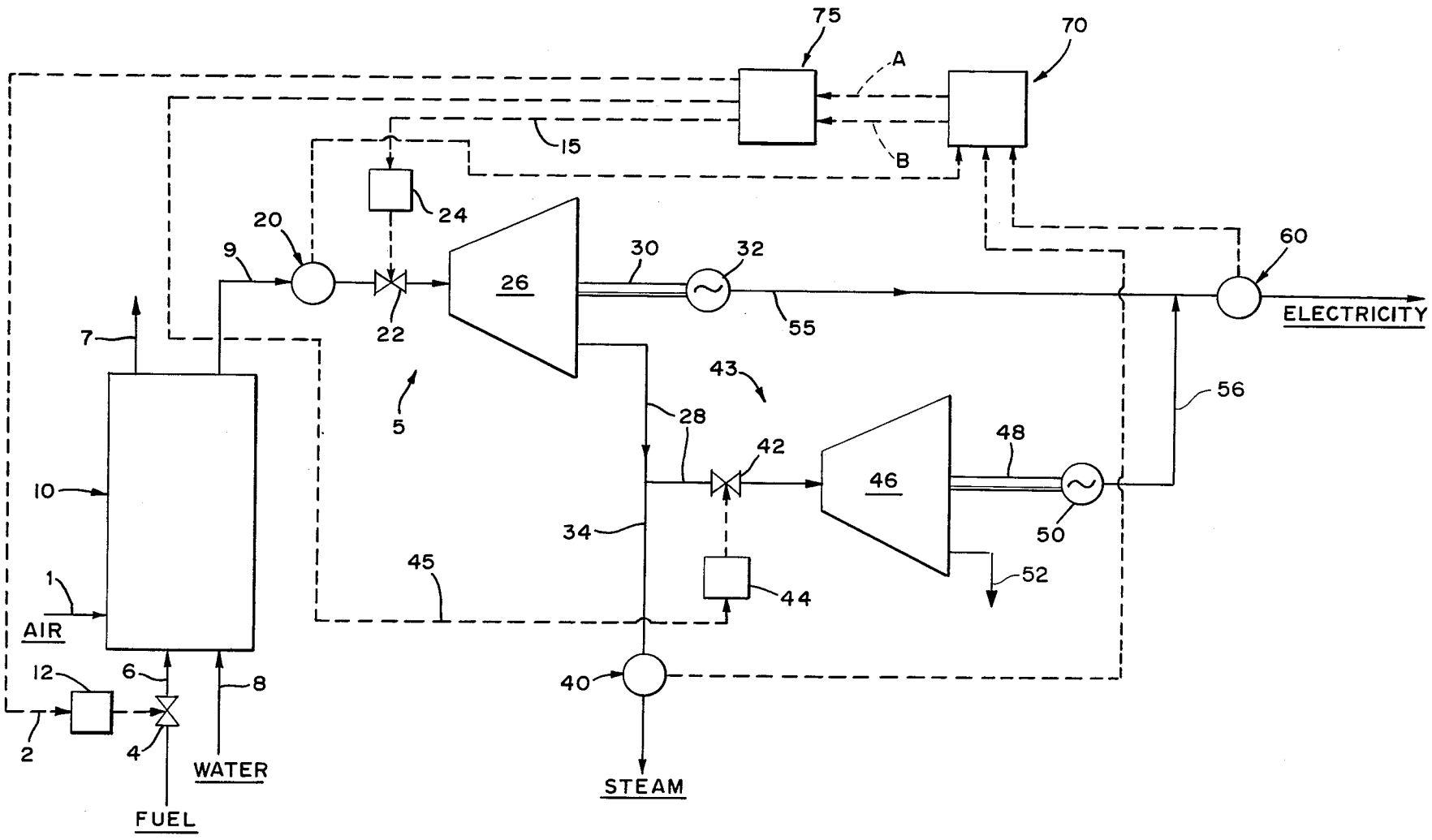
ELECTRICITY
60
56
70
50
52
48
46
A
B
75
55
32
43
42
44
28
30
34
40
STEAM
15
26
24
22
5
45
20
9
8
WATER
FUEL
6
4
7
10
1
AIR
12
2

CONTROL OF A STEAM-HEATING POWER PLANT

BACKGROUND OF THE INVENTION

1. Field of the Invention

This invention relates to the production of electricity and steam from steam-heating power plants and, more particularly, to apparatus for control of such power plants to meet changes in electrical and steam-heat demand placed on a power facility.

2. Description of the Prior Art

Conventional manufacturing facilities generally require use of a wide variety of energy in the form of electricity and/or steam to operate equipment essential to the manufacturing of the desired product, as well as for heating and comfort control. The electrical requirements of a given facility can of course be met by purchasing electricity from utility companies. To a large degree, these utilities produce electricity by the well known Rankine Cycle employing water as the Rankine Fluid by way of combustion of fossil fuels. Electricity is also produced by hydroelectric or nuclear methods. However, in the fossil fuel systems steam, produced at a high pressure and temperature in boilers which burn fuel to heat water passed therethrough, is expanded nearly adiabatically through succeeding stages of axially rotating turbine blades. At each stage of expansion the energy content of enthalpy of the steam is lowered, raising the mechanical rotational energy transmitted to a rotating shaft attached to the blades by an amount corresponding to the decrease in enthalpy less, of course, the inevitable losses due to friction, etc. The energy transferred to the rotating shaft is converted into electricity by means of a generator coupled to the rotating shaft.

A limit, however, exists on the number of expansion stages possible in a turbine and on the amount of energy which can be eventually extracted as electrical power from that energy originally imparted to the steam from the burning of the fuel. The steam vapors exhausted from the last turbine stage of expansion still contain the latent heat of vaporization and are usually passed to an apparatus wherein the steam is suitably treated to cool and condense the vapors, with the heat thereby extracted from the steam being taken to waste. While some condensation does occur in the expansion process due to the thermodynamic properties of steam, the greater percentage of the energy originally delivered to the steam in the boilers can be practically considered as lost. The most efficient power generating plants which produce electricity from fossil fuels convert to electricity only 46 percent of the energy originally imparted to the steam, with a remaining 54 percent of the energy originally imparted to the steam being wasted.

While the steam vapors which exit the last turbine stage of the utility company may be sold as a source of heat, industrial facilities or others requiring the steam in manufacturing or in heating may not be located convenient to the utility plant. In these cases, the transmission of steam over long distances to the end user would be uneconomical and would result in a substantial transmission heat loss. Thus, to take advantage of the heat remaining in steam following exhausted from the last turbine stage of an electrical generating apparatus system, industrial designers have recognized that local generation of the electricity within an industrial facility would enable efficient use of the energy of the exhausted steam which would otherwise be wasted to the environment. Therefore, manufacturing industries using large quantities of steam can find it very economical to generate steam at a high pressure, pass the steam through a turbine to generate electricity used within the plant, and then employ the exhausted steam at a lower pressure and temperature for use in manufacturing processes. Such systems are herein referred to as "steam-heating power plants." Since the electrical generating apparatus in such a facility would not need to take the steam to as close to the low temperature condensing conditions (e.g., from about 75° to 130° F) as would be necessitated by utility companies in which the steam would otherwise be discharged to waste, work in the form of electricity can be extracted from the steam passed through the turbine to about a 90 percent efficiency. Turbines selected to operate in ranges where conditions of temperature at exhaust or extraction can be gainfully used for other purposes are often called "topping turbines," with the electrical energy being produced being called "topping power." In contrast, turbines employed in utility companies which, for economic reasons must take the steam to as close to low temperature condensing conditions as possible, are termed "condensing turbines" with electricity being produced being termed "condensing power."

Steam-heating power plants typically include at least one topping turbine and at least one condensing turbine, and are generally supplied with steam from at least one steam generating source, e.g. a fossil fuel-burning boiler. High-pressure steam, e.g., 400 to 1500 psig, is generally first passed from the steam source through the topping turbines for generation of electricity. Lower pressure steam exhausted from the topping turbines is herein termed "intermediate pressure steam" and possesses a pressure between that of the high pressure steam fed to the turbine and that pressure corresponding to condensing conditions. The intermediate pressure steam will typically have a pressure of from 100 to 550 psig, although this may vary widely depending on equipment design and other factors. This intermediate pressure steam is in part passed to the condensing turbines for generation of additional electricity. Steam required for meeting heating and other process requirements may be withdrawn from the topping turbines or condensing turbines at any stage thereof, or as is more typical such steam may be withdrawn from the line containing the intermediate pressure steam which is exhausted from the topping turbines. The rotational mechanical energy from the topping and condensing turbines is generally transferred to separate generators for production of electricity. The electrical outputs from these generators are usually to a common electrical network or load.

In designing an industrial complex to include a steam-heating power plant, an ideal energy balance is provided when the demand for electrical energy can be supplied by electricity produced in the topping turbines with demand for heat energy in the form of steam being equivalent to that steam exhausting from the topping turbines.

In practice, however, an ideal balance is seldom achieved. Many factors unpredictable and beyond ordinary human control cause disruptions in energy consumption patterns of the individual processing sections which form a part of the steam-heating power plant. Examples of these disturbances include changes in weather conditions, equipment down-time, intermediate storage, market conditions, etc. If there then is a greater demand for steam than for electricity, and if steam demands are to be met by the steam-heating power plant, the opportunity is lost to produce cheap electricity at this facility since that portion of the steam diverted to the heating requirements cannot be used to generate electricity. If there is a greater demand for electricity than can be generated from the steam produced in the topping turbine system, then the electricity must also be supplemented. This supplemental electricity can be obtained from an alternative source, such as by purchasing electricity from a utility, or can be produced by passing additional amounts of steam to a condensing turbine or even by an internal combustion engine. However, whatever the source of the supplemental electricity, it is always more expensive than that which can be generated by the topping turbines.

Prior art practitioners have attempted to control the generation of electricity and steam by such a system by sensing the initial steam boiler pressure and regulating, as with a suitable responsive control mechanism, the fuel fed to the boilers to keep the boiler pressure constant. The pressure of the intermediate pressure steam exhausted from the topping turbine is also sensed and the quantity of steam permitted to pass through the topping turbines is, as by a suitable responsive control mechanism, regulated to maintain a constant pressure in the steam line containing the intermediate pressure steam. Generation of electric power is controlled by sensing the frequency of the power that is generated and regulating the steam passed through the condensing turbine employing a suitable responsive control mechanism to maintain constant frequency of the generated electricity.

However, this method of control has proved unsuitable in situations where there are fluctuations in steam or electrical demand as is generally the case in any manufacturing facility. Interaction between the various pressure and frequency sensing mechanisms causes cycling between the control mechanisms which are responsive to their various signals.

For example, a decrease in the electrical demand results in an increased electrical frequency of the power plant. This is detected by the frequency control mechanism which then reduces the quantity of steam permitted to pass through the condensing turbine in an attempt to maintain a constant frequency. However, this has the effect of raising the steam pressure in the topping turbine exhaust line which feeds the condensing turbine and from which steam is withdrawn to the manufacturing plant. This pressure change is detected by the pressure sensor on this intermediate pressure steam line, causing a corresponding reduction in the quantity of steam permitted to pass through the topping turbines so as to maintain a constant steam pressure. However, this results in a decreased generation of topping power and has a delayed effect of lowering the frequency detected by the frequency sensor. The frequency controller would then seek to increase the quantity of steam passed through the condensing turbine to offset the detected frequency decrease, thereby causing more of the steam exiting the topping turbine to be consumed in the condensing turbine and resulting in a pressure drop in the topping turbine exhaust line. This pressure drop is then in turn sensed by the control mechanism on this line which increases the amount of steam fed to the topping turbines, resulting in a rise in the generated frequency. Once the cycle begins it continues indefinitely.

The prior art has attempted to overcome this problem of cycling by interposing a regulating valve between the steam line from the boiler which feeds the topping turbine and the intermediate pressure line receiving the topping turbine exhaust. By use of this regulating valve, commonly used in conjunction with a de-superheater, steam is expanded isenthalpically into the intermediate pressure pipe which receives the topping turbine exhaust. As before, the pressure of the topping turbine steam fed is sensed and operates to control the quantity of fuel fed to the boilers. A change in the electrical demand, as manifested by change in the generating frequency, would be sensed and caused to regulate the quantity of steam passed through the condensing turbine for increased or decreased generation of electricity therein. However, the controller which receives the pressure signal from the sensor on the intermediate pressure steam line, instead of regulating the quantity of steam passed through one or more topping turbine, instead regulates the valve which by-passes the topping turbines, allowing steam produced in the boiler to feed directly into the line which receives the topping exhaust.

While incremental changes in the pressure of the topping exhaust do not materially interfere with the frequency control mechanism operating to sense the frequency of the electricity generated in the topping turbine downstream of this exhaust, and while the use of such a by-pass valve reduces the cycling problem, it is readiy apparant that by-passing the topping turbines in this manner is disadvantageous since the opportunity is lost to generate the cheaper topping power. This decreased quantity of electricity must therefore be supplied instead from more expensive sources as discussed previously. This is a serious deficiency in an industrial steam-heating power plant due to the large quantities of steam that are employed.

SUMMARY OF THE INVENTION

In accordance with the present invention, a control system is provided for an apparatus adapted for producing steam and electricity to meet demands for same, said apparatus including (1) steam generator means for producing high pressure steam in response to a fuel load signal, (2) first turbine means for producing electricity from said high pressure steam, said first turbine means being adapted to exhaust intermediate pressure steam having a pressure between the high pressure steam and that pressure corresponding to condensing conditions, (3) second turbine means for producing electricity from a portion of said intermediate pressure steam and (4) means for withdrawal the remaining intermediate pressure steam to supply said steam demand, said first and second turbine means being adapted to supply electricity to a common power network and each turbine means having means for setting the turbine load level in response to a load command signal, said control system comprising:

a. means for sensing steam and electricity demand-variables,
b. means for comparing said sensed demand-variables with the electricity and steam outputs of said first and second turbine means, respectively, and producing adjusted load command signals for each turbine means,
c. means for producing an adjusted fuel-load signal for said steam generator means in response to said adjusted load command signals, and d. means for transmitting said turbine load command signals to said first and second turbine means, respectively, and said adjusted fuel-load signal to said steam generator means for coordinated adjustment of said steam generator means and said first and second turbine means.

The present invention achieves maximum generation of topping power produced in topping turbines while at the same time eliminating interference between steam and electricity sensing means and load controllers for the turbines and steam generator.

BRIEF DESCRIPTION OF THE DRAWINGS

The subject matter which is regarded as the invention is particularly pointed out and distinctly claimed in the concluding portion of the specification. The invention, however, both as to organization and method of practice, may best be understood by reference to the following description taken in connection with the accompanying drawing which is a simplified block diagram of a control system of the present invention for control of a steam-heating power plant.

DESCRIPTION OF THE PREFERRED EMBODIMENT

Referring to the accompanying diagram, steam generator means, indicated generally at 10, supplies steam via line 9 to first turbine means, indicated generally at 5, which comprises regulator 22, topping turbine 26, shaft 30 and electricity generator 32 for production of electricity. It will be recognized that steam generator means 10 can comprise either a conventional boiler, fired by fossil fuel (e.g., oil or coal) or a steam producing facility heated by a nuclear reactor employing nuclear fuel. The rate of supply of fuel to steam generator 10 is regulated by controller 12 which adjusts the position of control element 4 suited for the particular type of fossil or non-fossil fuel, including coal, oil, gas or radioactive fuel. In further description of the steam-heating power plant of the accompanying drawing, steam generator means 10 will be assumed to comprise a fuel-burning boiler.

Water is introduced via line 8 to boiler 10 wherein the water is heated by the burning of fuel, introduced to the boiler via line 6, with air fed to boiler 10 via line 1, thereby producing high pressure steam exiting boiler 10 by way of line 9, and vent gases exiting via line 7. Control element 4 is interposed in line 6 to control the amount of fuel fed to the boiler. In the instance in which control element 4 comprises a valve, the valve may be positioned by means of an electrohydraulic servo mechanism 12 in response to a fuel-load signal entering at 2. Servo mechanism 12, may, for example, comprise a conventional arrangement of solid-state analog circuits utilizing operational amplifiers and servo valves controlling high pressure hydraulic rams to control the opening of valve 4. The higher the load command signal, the wider the valve opening. It will be understood that boiler 10 may also include various other controllers to regulate the air feed to the boiler, the vent from the boiler, the water feed rate, etc. However, these are known to one having ordinary skill in the art and their detailed description is not necessary to the present invention. Where such additional controllers are employed, a single servo mechanism 12 may typically operate to position control valves on such feed and vent lines in response to the fuel-load signal entering at 2. Pressure sensing means, indicated generally at 20, for sensing the pressure of steam is provided in line 9, and may comprise a conventional pressure sensor such as a strain gauge attached to expanding bellows.

The high pressure steam passes through regulator 22 and into turbine 26. Rotating shaft 30 transfers the rotational, mechanical energy produced in turbine 26 to electricity generator 32 for generation of electrical power. Intermediate pressure steam, that is, steam having a pressure between that of the high pressure steam and that pressure corresponding to condensing conditions, is exhausted from turbine 26 into line 28. A portion of the intermediate pressure steam is passed to second turbine means, indicated generally at 43, for generation of additional electricity. In the apparatus of the accompanying drawings, second turbine means comprises regulator 42, turbine 46 and electrical generators 50. As with turbine 26, the amount of steam which is introduced to turbine 46 is controlled by regulator 42, with the rotational, mechanical energy produced in turbine 46 being transferred to electricity generator 50 by means of rotating shaft 48, for generation of additional electricity.

It will be understood that the foregoing components are only a rudimentary representation of what can be an extremely complex power plant, each turbine 26 and 46 perhaps representing a number of separate turbine casings with reheating of the steam between casings or a plurality of turbines, each provided with a separate electricity generator. It will also be understood that many other types of controls and additional valves or regulators for emergency control and other purposes would normally be included. These are not shown since they are not material to the invention.

As with control element 4, in the instance in which regulators 22 and 42 each comprises a valve, the valve may be positioned by means of electrohydraulic servo mechanisms 24 and 44, respectively, in response to individual electrical "load command" signals entering at 15 and 45, respectively. Thus, in turbine 26 the load level of the turbine, that is, the amount of steam passing through the turbine and hence the amount of rotational mechanical energy produced therein, is set by means of regulator 22. Similarly, regulator 44 sets the turbine load level for condensing turbine 46.

Electricity generators 32 and 50 are connected to a common power network (not shown) via lines 55 and 56, which are provided with sensing means, indicated generally at 60, for sensing one or more electrical demand-variable indicative of the electrical demand placed by the power network to which lines 55 and 56 provide electricity. Such sensing means are conventional and their description is not necessary here. By the term "electrical demand-variable" is meant any electrical quality which is indicative of demand, e.g., frequency, voltage, amperage, etc. It will be understood that sensing means 60 can operate to sense any of these variables and that the relationships between the sensed demand-variable and electrical demand are known in the art. Thus, for example, an increased electrical demand will effect a decrease in the sensed frequency and, conversely, an increase in electrical frequency will result from a decrease in electrical demand.

Steam is exhausted from condensing turbine 46 by means of line 52 and may be optionally passed to a conventional condenser (not shown) for condensation of the steam, with recycle of the condensate to boiler 10 for production of additional steam.

The intermediate pressure steam exhausted from topping turbine 26 which is not passed to condensing turbine 46 is withdrawn by way of line 34 and passed to other processes (not shown) to satisfy the steam demand thereof, e.g., for steam to be consumed in meeting heating and/or other process requirements. Line 34 is provided with sensing means, indicated generally at 40, for sensing one or more steam demand-variable indicative of the steam demand placed on the steam-heating power plant illustrated in the accompanying drawing. By the term "steam demand-variable" is meant any quality of steam that is indicative of demand, e.g., pressure, temperature, etc. Sensing means 40 may comprise any conventional device employed for measuring such demand-variables. Thus, a conventional pressure sensor adapted for measuring minor changes in steam pressure may be employed. As will be understood by the skilled practitioner, a decrease in steam demand is reflected by an increase in pressure of steam contained in line 34. Conversely, an increase in steam demand results, without any change in operating parameters of the steam-heating power plant, in a decrease in steam line pressure. Relationships between steam demand and the temperature of steam in line 34 are also known and need not be described here.

Sensing means 50 for sensing electricity demand-variables is electrically connected to means, indicated at 70, for comparing the sensed electricity demand-variable with the electricity output of generators 32 and 50, which may, for example, be supplied to comparing means 70 by conventional devices (not shown) producing electrical signals in proportion to the amount of steam fed to each turbine 26 and 46 and the quantity of electricity produced therein, as determined by known operating curves for each turbine. Sensing means 40 for sensing steam demand-variables is also electrically connected to comparing means 70 for comparing the sensed steam demand-variable with the throughput in line 34 of intermediate pressure steam. As before, the throughput in line 34 of intermediate pressure steam, i.e., the steam "output" of the steam-heating power plant, may be determined by a conventional device (not shown) producing an electrical signal, transmitted to comparing means 70, in proportion to the quantity of steam exhausted from first turbine means 5 which is not consumed by second turbine means 46. Since the quantity of steam passed through turbines 26 and 46 and the operating curves for each turbine is known, the amount of steam passing through line 34, and hence the pressure and/or temperature, thereof, can be determined.

Comparing means 70 thus produces a separate adjusted load command signal, e.g., signals "A" and "B," for first and second turbine means, respectively, to change the turbine load levels (e.g., steam throughput) responsive to the sensed electricity and steam demand-variables, so as to adjust the turbine load settings to provide steam and electricity in amounts substantially equivalent to the steam and electricity demands, respectively.

The adjusted load command signals A and B are transmitted to means, indicated generally at 75, for producing an adjusted fuel-load signal 2 for boiler 10 in response to the adjusted load command signals A and B for turbines 26 and 46. In producing adjusted fuel-load signal 2 for boiler 10, means 75 compares the amount of steam actually produced in boiler 10 with that quantity of steam which will be required to supply the steam-requirements of turbines 26 and 46 based on the adjusted load command signals A and B produced by comparing means 70. The determination by means 75 of the amount of steam actually produced in boiler 10 may be based, for example, on an electrical signal produced by pressure sensor 20 in proportion to the steam pressure in line 9. Alternatively, any other quality of steam that is proportional to the amount of steam produced in boiler 10 may be transmitted to means 75 by conventional sensing devices (not shown).

When desired, an electrical feedback correction signal, also proportional to steam production in boiler 10, may be transmitted from such sensing devices (e.g., pressure sensor 20) to means 75 to provide correction for any difference between the calculated change in steam production to be made in boiler 10 by virtue of the previous adjusted fuel-load signal and the actual steam production which resulted. It will be understood that the operating curve for boiler 10 is subject to change and will depend on a wide variety of variables, such as the quality of fuel, the impurity content of water and the oxygen content of air fed to the boiler as well as other factors. Thus, a feedback correction signal from means 75 to controller 12 is desirable to "fine tune" the boiler to achieve the steam production necessary to meet the changes in operating conditions for first turbine means 5 and second turbine means 43 resulting from adjusted load settings 15 and 45, respectively.

The adjusted fuel-load signal and adjusted load command signals are transmitted by means 75 to the respective controller, i.e., adjusted fuel-load signal 2 is transmitted to controller 12 for coordinated adjustment of regulator 4, adjusted load command signal 15 is transmitted to controller 24 for coordinated adjustment of regulator 22; and adjusted load command signal 45 is transmitted to controller 44 for coordinated adjustment of regulator 42.

In further describing the operation of the control system of the accompanying drawing, examples of disturbances in the system will be followed. Thus, assuming initial equilibrium operating conditions (in which steam and electricity output equals the demands for same), any change in the electricity power demand-variable is sensed by sensing means 60 which then transmits to comparing means 70 an electrical signal in proportion to the sensed electricity demand-variable. As described above, comparing means 70 receives a separate electrical signal from first turbine means 5 and second turbine means 43 in proportion to the actual electricity output of generators 32 and 50, respectively. Assuming no change in steam demand, that is assuming the steam demand determined from the sensed steam demand-variable corresponds to the current steam throughput in line 34, comparing means 70 produces adjusted load command signals A and B, which (when transmitted to controllers 24 and 44, respectively) will effect the change in turbine load settings necessary to meet the sensed change in electricity demand, without altering the steam throughput in line 34. As will be evident, the selection of adjusted load command signals for transmission to first turbine means 5 and second turbine means 43 will depend upon a variety of factors, not the least of which is the operating curve for each such turbine. Thus, if the electrical demand determined from sensed demand-values is greater than the current output of generators 32 and 50 combined, the adjusted load command signal transmitted to controller 24 for adjustment of the load setting of topping turbine 26 is selected to coordinate the additional quantity of electricity to be produced by generator 32 with (1) the volume of additional intermediate pressure steam which will be exhausted from turbine 26 and (2) the additional quantity of steam to be passed through condensing turbine 46, so that the steam pressure in line 34 remains constant to supply the constant steam demand.

Conversely, if the electricity demand remains constant and the steam demand determined from the sensed steam demand-variable is different from the current steam throughput in line 34, then the adjusted load command signals A and B to first turbine means 5 and second turbine means 43, respectively, will be such as to adjust the load settings of turbines 26 and 46 to meet the change in steam demand while not significantly affecting the quantity of electricity produced.

Of course, if the electricity and steam demands as determined from the sensed electricity and steam demand-variables are the same as the electricity and steam output of the steam-heating power plant, no adjusted load command signals are produced by means 70 since no change in turbine load levels is required.

In description of comparing means 75, if the changes in steam and electricity demand are greater than can be met by adjusting first turbine means 5 and second turbine means 43 alone, then means 75 produces an adjusted fuel-load signal so as to change the quantity of steam produced by boiler 10 in response to the adjusted load command signals produced by comparing means 70. Thus, if the sensed values of electricity and steam demand require greater quantities of steam to produce a greater electricity and/or steam output, means 75 produces an adjusted fuel-load signal to controller 12 for adjustment of regulator 4 to increase the quantity of fuel fed to boiler 10 for production of that additional amount of steam which is necessary to supply the increased steam requirements of first and second turbine means 5 and 43. Conversely, if the total quantity of electricity and steam energy demanded of the steam-heating power plant decreases, comparing means 75 produces an adjusted fuel-load signal to controller 12 which will operate to decrease the quantity of fuel passed through regulator 4 so as to decrease the amount of steam produced in boiler 10.

As will be evident to the skilled practitioner, the adjustments in turbine load levels for first turbine means 5 and second turbine means 43 and in the fuel consumption rates of boiler 10 may be made in either a step-wise fashion to provide incremental changes in operating conditions or in a ramp fashion, as indicated by plot of regulator position versus time, to provide continuous changes. Also in the practical operation of the control system of the present invention, adjusted load command signals and adjusted fuel-load settings will compensate for such diverse process variables as steam loss in transmission of steam through plant piping, delay times in distances between apparatus, lag times in response of individual controllers and regulators and inertia characteristics of the turbines employed in first and second turbine means 5 and 43, respectively. Such signals should also compensate for any non-linearity of operating curves for turbines 26 and 46 and boiler 10.

As will also be obvious to the skilled practitioner, comparing means 70 and comparing means 75 for producing the adjusted operating signals in the control system of the present invention may comprise conventional analog or digital circuitry. Thus, a digital computer may be employed as comparing means 70 and 75. It will be also obvious to the skilled practitioner that the logic circuitry which may be employed is quite complex and will vary widely depending on the particular apparatus employed in the steam-heating power plant. Thus, a description of the logic circuitry is not necessary to the present invention since it can be easily derived by the skilled practitioner for a given steam-heating power plant.

Since various changes and modifications may be made in the invention without departing from the spirit thereof, it is intended that all matter contained in the description shall be interpreted as illustrative and not in a limiting sense.

I claim:

1. A control system for an apparatus adapted for producing steam and electricity to meet demands for same, said apparatus including (1) steam generator means for producing high pressure steam in response to a fuel load signal, (2) first turbine means for producing electricity from said high pressure steam, said first turbine means being adapted to exhaust intermediate pressure steam having a pressure between the high pressure steam and that pressure corresponding to condensing conditions, (3) second turbine means for producing electricity from a portion of said intermediate pressure steam and (4) means for withdrawal of the remaining intermediate pressure steam to supply said steam demand, said first and second turbine means being adapted to supply electricity to a common power network, each turbine means having means for setting the turbine load level in response to a load command signal, said control system comprising:

a. means for sensing steam and electricity demand-variables, b. means for comparing said sensed demand-variables with the electricity and steam outputs of said first and second turbine means, respectively, and producing adjusted load command signals for each turbine means, c. means for producing an adjusted fuel-load signal for said steam generator means in response to said adjusted load command signals, and d. means for transmitting said turbine load command signals to said first and second turbine means, respectively, and said adjusted fuel-load signal to said steam generator means for coordinated adjustment of said steam generator means and said first and second turbine means.

2. In apparatus adapted for producing steam and electricity to meet demands for same which comprises: (1) a steam generator for producing high pressure steam from fuel in response to a fuel-load setting signal, (2) first turbine means for producing electricity from said high pressure steam, said first turbine means being adapted to exhaust intermediate pressure steam having a pressure between the high pressure steam and that pressure corresponding to condensing conditions, (3) second turbine means for producing electricity from a portion of said intermediate pressure steam, and (4) means for withdrawing the remaining intermediate pressure steam to supply said steam demand, said first and second turbine means being adapted to supply electricity to a common power network and each turbine means having means for setting the turbine load-level in response to a load command signal, the improvement which comprises a system for coordinating control of the amounts of steam and electricity produced including: (a) means for sensing steam and electricity demand-variables, (b) means for comparing said sensed demand-variables with the electricity output and steam output of said first and second turbine means, respectively, and adjusting the load command signals for said first and second turbine means, (c) means for adjusting the fuel-load setting signal for said steam generator means to correlate it with said adjusted load command signals, and (d) means for transmitting said adjusted turbine load signals to said first and second turbine means, respectively, and said adjusted fuel-load settings signal to said steam generator means.

* * * * *